US007750616B2

(12) United States Patent
Liu

(10) Patent No.: US 7,750,616 B2
(45) Date of Patent: Jul. 6, 2010

(54) BUCK CONVERTER LED DRIVER CIRCUIT

(75) Inventor: Kwang-Hwa Liu, Sunnyvale, CA (US)

(73) Assignee: Green Mark Technology Inc., Tao-Yuan County (TW)

( * ) Notice: Subject to any disclaimer, the term of this patent is extended or adjusted under 35 U.S.C. 154(b) by 511 days.

(21) Appl. No.: 11/766,319

(22) Filed: Jun. 21, 2007

(65) Prior Publication Data

US 2008/0316781 A1 Dec. 25, 2008

(51) Int. Cl.
*G05F 1/40* (2006.01)
*G05F 1/613* (2006.01)

(52) U.S. Cl. ..... 323/285; 323/284; 323/224; 323/266; 363/82

(58) Field of Classification Search ..... 323/222, 323/282, 284, 285, 290, 351, 224, 266; 363/82; 315/224, 308
See application file for complete search history.

(56) References Cited

U.S. PATENT DOCUMENTS

| | | | | |
|---|---|---|---|---|
| 7,202,608 | B2 * | 4/2007 | Robinson et al. | 315/224 |
| 7,245,089 | B2 * | 7/2007 | Yang | 323/282 |
| 2006/0113975 | A1 * | 6/2006 | Mednik et al. | 323/282 |
| 2008/0018261 | A1 * | 1/2008 | Kastner | 315/192 |

* cited by examiner

*Primary Examiner*—Jessica Han
(74) *Attorney, Agent, or Firm*—J.C. Patents

(57) ABSTRACT

A buck converter LED driver circuit is provided. The driver circuit includes a buck power stage, a rectified AC voltage source, a voltage waveform sampler, and a control circuit. The buck power stage includes at least one LED and provides a first signal directly proportional to the current through the LED. The rectified AC voltage source is coupled to the buck power stage for driving the buck power stage. The voltage waveform sampler is coupled to the rectified AC voltage source for providing a second signal directly proportional to the voltage provided by the rectified AC voltage source. The control circuit is coupled to the voltage waveform sampler and the buck power stage for turning on and turning off the buck power stage according to a comparison between the first signal and the second signal.

5 Claims, 4 Drawing Sheets

| α (°) | α (radian) | PF | α (°) | α (radian) | PF |
|---|---|---|---|---|---|
| 0 | 0 | 0.900 | 30 | 0.523 | 0.955 |
| 5 | 0.087 | 0.923 | 35 | 0.611 | 0.943 |
| 10 | 0.174 | 0.940 | 40 | 0.698 | 0.925 |
| 15 | 0.262 | 0.953 | 45 | 0.785 | 0.900 |
| 20 | 0.349 | 0.959 | 50 | 0.873 | 0.868 |
| 25 | 0.436 | 0.960 | 55 | 0.960 | 0.828 |

FIG. 7

BUCK CONVERTER LED DRIVER CIRCUIT

BACKGROUND OF THE INVENTION

1. Field of the Invention

The present invention relates to a light-emitting diode (LED) driver circuit. More particularly, the present invention relates to a buck converter LED driver circuit.

2. Description of the Related Art

An LED is similar to a silicon p-n junction diode. At its operating range, a slight change of forward voltage results in a large change in its operating current. Therefore, an LED requires constant current drive, not constant voltage drive. Any surge current above its rated current value will tend to degrade or even damage the LED.

Please refer to FIG. 1 and FIG. 2. FIG. 1 is a schematic diagram showing a conventional LED driver circuit with a buck converter topology. FIG. 2 shows some important waveforms in the LED driver circuit in FIG. 1. The alternating current (AC) voltage source 101 drives LEDs 103 through bridge rectifier 102. LEDs 103, inductor 104, and diode 105 are coupled as a loop. Here diode 105 is a fast-switching free-wheeling diode. Clock generator 106 provides a clock signal to the setting end (S) of SR flip-flop 108 so that the setting end is triggered and power switch Qm is turned on at each clock pulse. As power switch Qm is turned on, the current through LEDs 103 and inductor 104 gradually increases. At this time diode 105 is biased backward and does not conduct. Therefore the current through resistor Rsen is equal to the current through LEDs 103. When the LED current increases to the point where the voltage across resistor Rsen is higher than 0.5V, comparator 107 triggers the resetting end (R) of SR flip-flip 108 and power switch Qm is turned off. As power switch Qm is turned off, the LED current circulates in the loop formed by LEDs 103, inductor 104 and diode 105, decreasing gradually due to energy dissipation of LEDs 103 until the next clock pulse. As a result, the LED current exhibits a periodic zigzag waveform with a substantially constant level as shown in FIG. 2.

To assure the LED current is continuous, a large capacitor Cin, is connected between the bridge rectifier and the buck converter to hold up the input DC voltage Vcin such that Vcin is always higher than Vf, which is the voltage across LEDs 103. Without capacitor Cin, as the rectified input voltage Vin falls below Vf, the LED current would cease to flow. Therefore, the conventional driver circuit in FIG. 1 requires a large capacitor Cin and the input current Iin exists only when the rectified input voltage Vin is higher than the input DC voltage Vcin, as shown in FIG. 2. The large capacitance of Cin leads to a narrow range of conducting phase angle and a very poor input power factor. As shown in FIG. 2, the input current Iin conducts only for a small portion of the AC cycle time. The power factor is typically less than 0.65.

For a conventional buck converter LED driver circuit to feature a higher power factor, a solution is to incorporate a power factor correction (PFC) front-end as shown in FIG. 3. FIG. 3 is a schematic diagram showing a conventional buck converter LED driver circuit with a boost PFC front-end controlled by a PFC boost control circuit 110. Although the driver circuit in FIG. 3 has a higher power factor, it is far more complex than the driver circuit in FIG. 1. In many LED lamp fixtures, there is not sufficient space for the additional components.

SUMMARY OF THE INVENTION

Accordingly, the present invention is directed to a buck converter LED driver circuit. The driver circuit features a simple design and a high input power factor without the requirement for a large capacitor.

According to an embodiment of the present invention, a buck converter LED driver circuit is provided. The driver circuit includes a buck power stage, a rectified AC voltage source, a voltage waveform sampler, and a control circuit. The buck power stage includes at least one LED and provides a first signal directly proportional to the current through the LED. The rectified AC voltage source is coupled to the buck power stage for driving the buck power stage. The voltage waveform sampler is coupled to the rectified AC voltage source for providing a second signal directly proportional to the voltage provided by the rectified AC voltage source. The control circuit is coupled to the voltage waveform sampler and the buck power stage for turning on and turning off the buck power stage according to a comparison between the first signal and the second signal.

In an embodiment of the present invention, the control circuit includes an SR flip-flop, a clock generator, and a comparator. The SR flip-flop has an output end coupled to the buck power stage for turning on and turning off the buck power stage. The clock generator is coupled to the SR flip-flop for providing a clock signal to the setting end of the SR flip-flip. The comparator has a positive end coupled to the buck power stage for receiving the first signal, a negative end coupled to the voltage waveform sampler for receiving the second signal, and an output end coupled to the resetting end of the SR flip-flop.

In another embodiment of the present invention, the control circuit includes an SR flip-flop, a comparator, and a constant off-time generator. The SR flip-flop has an output end coupled to the buck power stage for turning on and turning off the buck power stage. The comparator has a positive end coupled to the buck power stage for receiving the first signal, a negative end coupled to the voltage waveform sampler for receiving the second signal, and an output end coupled to the resetting end of the SR flip-flop. The constant off-time generator is coupled to the SR flip-flop and the comparator for triggering the setting end of the SR flip-flip at a predetermined constant time after the output of the comparator is asserted.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 7 is a table showing the input power factor of the circuit in FIG. 4 with various spans of conducting phase angles.

DESCRIPTION OF THE EMBODIMENTS

Figure 1:
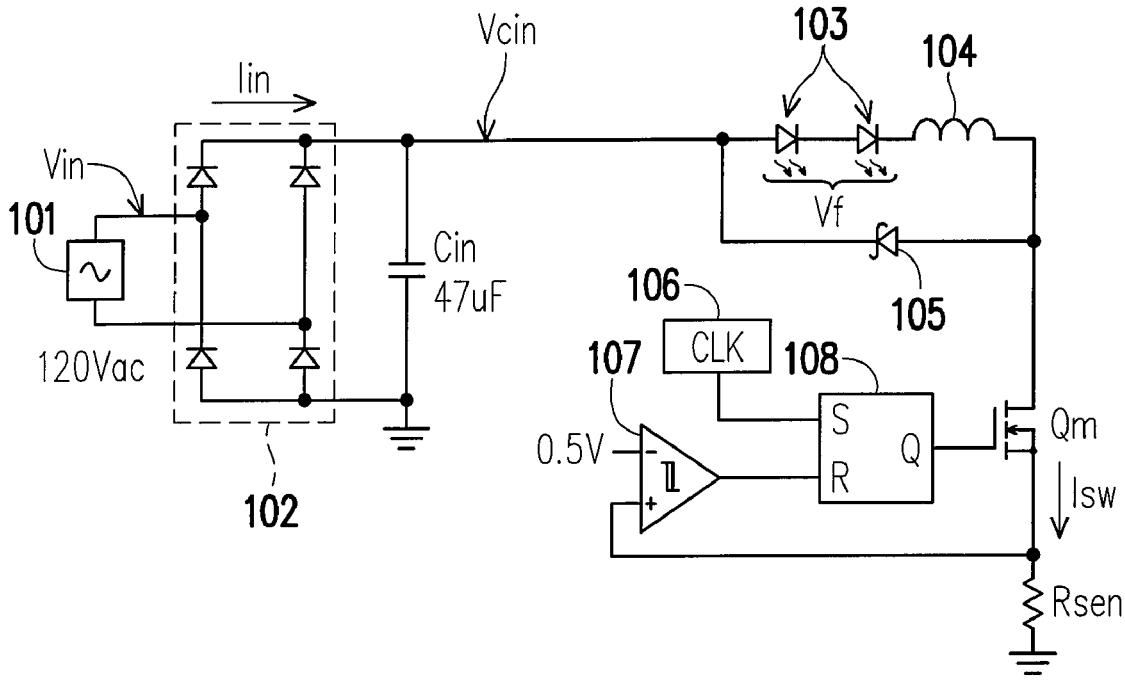
FIG. 1 (PRIOR ART)
FIG. 1 is a schematic diagram showing a conventional buck converter LED driver circuit.
Figure 2:
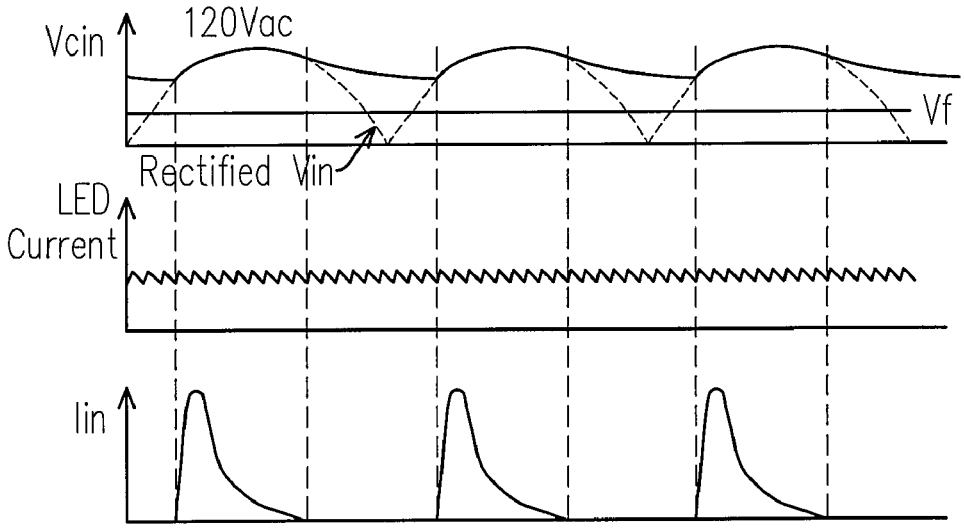
FIG. 2 (PRIOR ART)
FIG. 2 is a schematic diagram showing some important signal waveforms in the driver circuit in FIG. 1.
Figure 3:
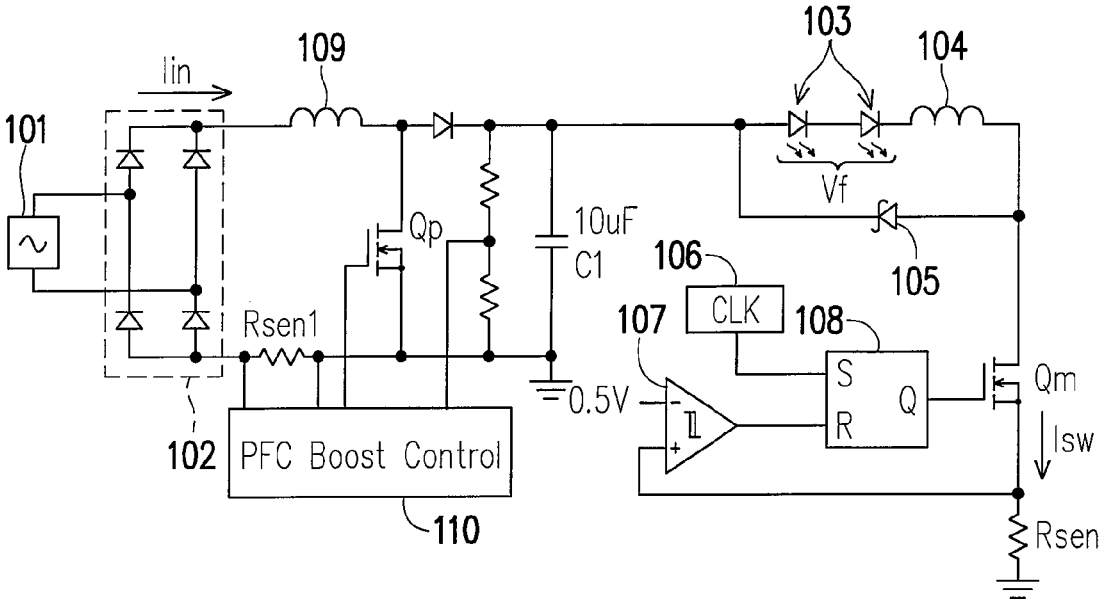
FIG. 3 (PRIOR ART)
FIG. 3 is a schematic diagram showing a conventional buck converter LED driver circuit with a boost PFC front-end.

Reference will now be made in detail to the present embodiments of the invention, examples of which are illustrated in the accompanying drawings. Wherever possible, the same reference numbers are used in the drawings and the description to refer to the same or like parts.

Figure 4:
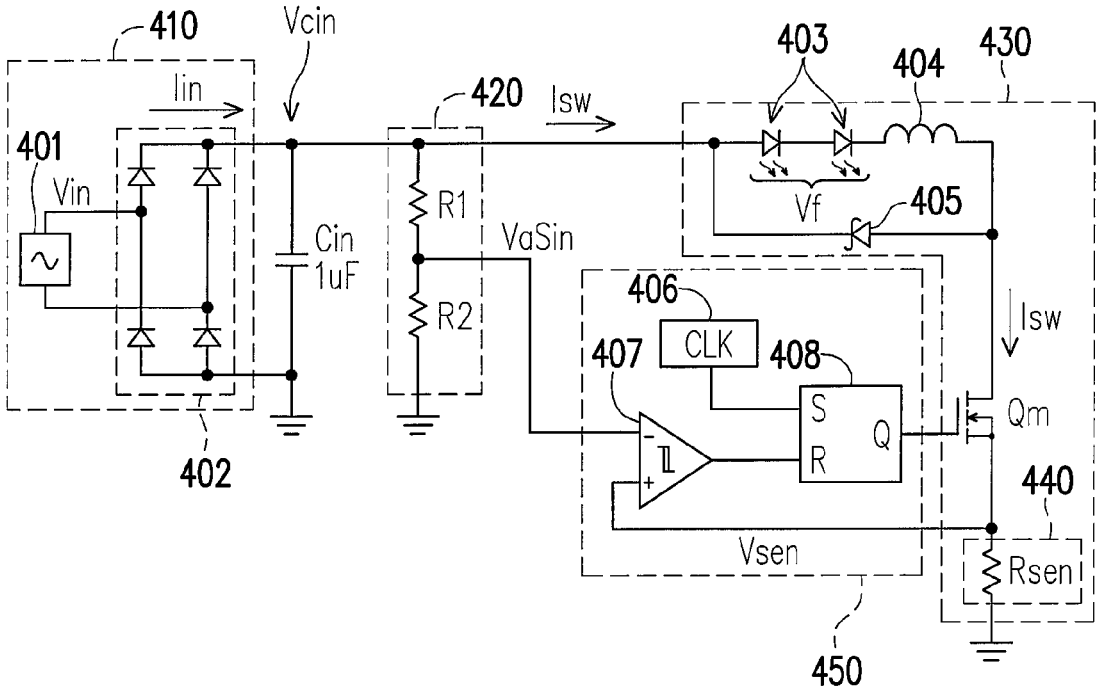
FIG. 4 is a schematic diagram showing a buck converter LED driver circuit according to an embodiment of the present invention.

Please refer to FIG. 4. FIG. 4 is a schematic diagram showing a buck converter LED driver circuit according to an embodiment of the present invention. This driver circuit includes a rectified AC voltage source 410, a capacitor Cin, a voltage waveform sampler 420, a buck power stage 430, and a control circuit 450. The buck power stage 430 includes two LEDs 403 and provides a voltage signal Vsen which is directly proportional to the current through LEDs 403. The rectified AC voltage source 410 is coupled to buck power stage 430 for driving buck power stage 430. The capacitor Cin is coupled between the two output ends of the rectified AC voltage source 410. Voltage waveform sampler 420 is coupled to the rectified AC voltage source 410 for providing another voltage signal VaSin which is directly proportional to the voltage provided by the rectified AC voltage source 410. Control circuit 450 is coupled to voltage waveform sampler 420 and buck power stage 430 for turning on and turning off buck power stage 430 according to the comparison between the voltage signals Vsen and VaSin.

The rectified AC voltage source 410 includes an AC voltage source 401 and a bridge rectifier 402 coupled to AC voltage source 401. Voltage waveform sampler 420 includes resistors R1 and R2. Resistor R1 is coupled to the rectified AC voltage source 410. Resistor R2 is coupled between resistor R1 and the ground. Signal VaSin is provided at the joint of the resistors R1 and R2. R1 and R2 constitute a voltage divider circuit, therefore signal VaSin is directly proportional to the output voltage of the rectified AC voltage source 410.

In addition to LEDs 403, buck power stage 430 includes an inductor 404, a diode 405, a power switch Qm, and a current sensor 440. Current sensor 440 includes a resistor Rsen coupled in series with LEDs 403. Resistor Rsen converts the current through LEDs 403 into voltage and provides the voltage signal Vsen at an end of resistor Rsen. Control circuit 450 turns on buck power stage 430 by turning on power switch Qm and turns off buck power stage 430 by turning off power switch Qm.

The relative positions of the components of buck power stage 430 are quite flexible, not limited to the topology shown in FIG. 4. The first general rule is that LEDs 403, inductor 404, power switch Qm, and current sensor 440 are coupled in series between the rectified AC voltage source 410 and the ground so that current sensor 440 can sense the current through LEDs 403 and power switch Qm can cut off the LED current. The second general rule is that LEDs 403, inductor 404, and diode 405 are coupled as a current loop so that the LED current can flow around the loop when power switch Qm is turned off. The third general rule is that power switch Qm is outside the current loop, otherwise Qm would cut off the LED current when it is turned off. For example, power switch Qm may be coupled between voltage waveform sampler 420 and the current loop instead of between the current loop and current sensor 440. For another example, current sensor 440 may be coupled between the current loop and power switch Qm instead of between power switch Qm and the ground.

Control circuit 450 includes an SR flip-flop 408, a clock generator 406, and a comparator 407. SR flip-flop 408 has a setting end (S), a resetting end (R), and an output end (Q). The output end is coupled to power switch Qm for turning on and turning off buck power stage 430. Clock generator 406 is coupled to SR flip-flop 408 for providing a clock signal to the setting end of SR flip-flip 408. Comparator 407 has a positive end, a negative end, and an output end. Its positive end is coupled to current sensor 440 for receiving signal Vsen. Its negative end is coupled to voltage waveform sampler 420 for receiving signal VaSin. Its output end is coupled to the resetting end of SR flip-flop 408. Whenever the level of signal Vsen is higher than the level of signal VaSin, the output of comparator 407 is asserted to trigger the resetting end of SR flip-flop 408.

Figure 5:
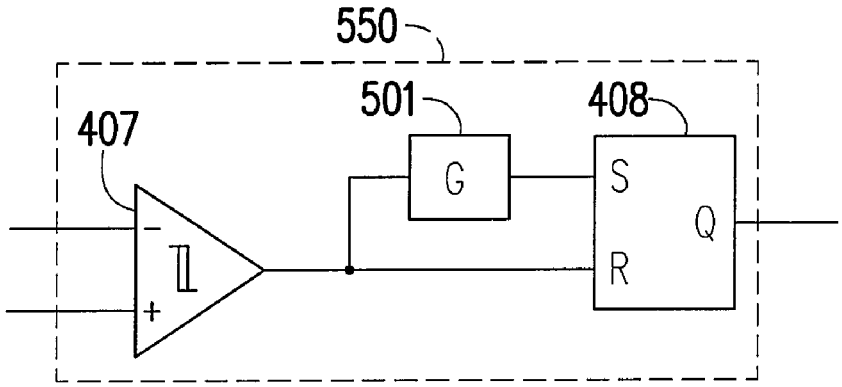
FIG. 5 is a schematic diagram showing an alternative design of the control circuit in FIG. 4.

Control circuit 450 has an alternative design which is shown in FIG. 5. FIG. 5 is a schematic diagram showing a control circuit 550 which may be used to replace control circuit 450 in FIG. 4. Control circuit 550 includes comparator 407, SR flip-flop 408, and a constant off-time generator 501. The difference between control circuits 450 and 550 is that clock generator 406 in control circuit 450 is replaced with constant off-time generator 501 in control circuit 550. Constant off-time generator 501 is coupled to SR flip-flop 408 and comparator 407 for triggering the setting end of SR flip-flip 408 at a predetermined constant time after the output of comparator 407 is asserted. For example, if the predetermined constant time is 10 microseconds, constant off-time generator 501 triggers the setting end of SR flip-flip 408 10 microseconds after the output of comparator 407 is asserted. The way of control of control circuit 550 over power switch Qm is substantially the same as that of control circuit 450 over power switch Qm.

Figure 6:
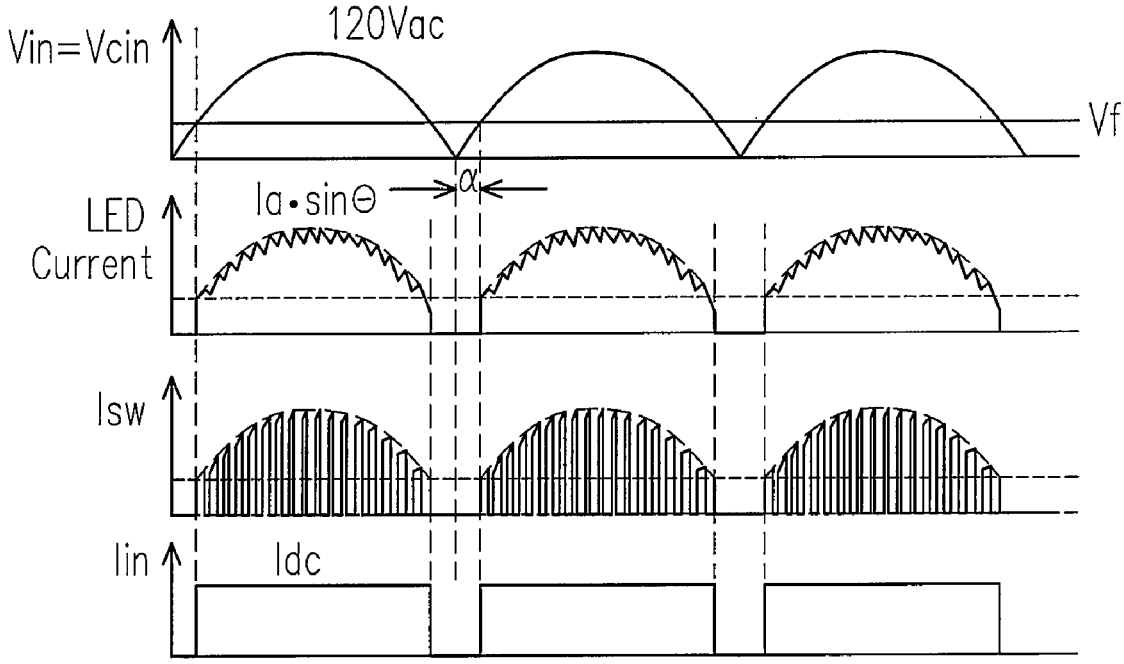
FIG. 6 is a schematic diagram showing some important signal waveforms in the driver circuit in FIG. 4.

Now please refer to FIG. 6. FIG. 6 shows some important signal waveforms in the driver circuit in FIG. 4, including input voltage Vin, the LED current, the current through current sensor 440, Isw, and input current Iin. There are two major differences between the LED driver circuits in FIG. 1 and FIG. 4. The first difference is that the large input hold-up capacitor Cin in FIG. 1 is reduced to a small filter capacitor in FIG. 4. For example, Cin in FIG. 1 may be 47 uF while Cin in FIG. 4 may be only 1 uF. Capacitor Cin in FIG. 4 is a small high-frequency input capacitor for filtering out the switching ripple current of buck power stage 430. Due to the reduction of Cin, we can assume the waveform of input DC voltage Vcin is the same as that of input voltage Vin, which is a standard rectified sine wave, as shown in FIG. 6. The second difference between the driver circuits in FIG. 1 and FIG. 4 is that the LED current in FIG. 1 is maintained at a substantially constant level because of the constant reference voltage of 0.5V received by comparator 107; while the LED current in FIG. 4 follows the waveform of input DC voltage Vcin because of the voltage signal VaSin provided by voltage waveform sampler 420, as shown in FIG. 6.

Clock generator 406 outputs a clock signal to the setting end of SR flip-flop 408. At each clock pulse, the setting end is triggered, the output of SR flip-flop 408 is asserted, and power switch Qm is turned on. When power switch Qm is turned on, the LED current is equal to the current through power switch Qm and current sensor 440, namely, Isw. Diode 405 is biased backward and does not conduct. The current through LEDs 403 and inductor 404 rises gradually to the point where the level of signal Vsen is higher than the level of signal VaSin, and then the output of comparator 407 triggers the resetting end of SR flip-flop 408, and then the output of SR flip-flop 408 turns off power switch Qm. When power switch Qm is turned off, the current Isw drops to zero, while the LED current circulates in the loop formed by LEDs 403, inductor 404 and diode 405 and decreases gradually due to energy dissipation of LEDs 403, until the next clock pulse from clock generator 406. All the currents shown in FIG. 6 have the same dead zones because LEDs 403 do not conduct when input voltage Vin falls below the voltage Vf across LEDs 403.

This embodiment of the present invention features a square-wave PFC. As shown in FIG. 6, the waveform of input current Iin during the conduction angle from a to $\pi$-$\alpha$ is a square wave. This is explained below.

Input voltage Vin may be expressed as Va·sin($\theta$), wherein Va is the amplitude of Vin and $\theta$ is the conduction phase angle from 0 to $\pi$. Input current Vin conducts only when Vin=Va·sin ($\theta$)>Vf.

Since buck power stage 430 is switching at a very high frequency (100 kHz or above), for each switching cycle, we can assume the LED current approximates a sine wave, Ia·sin ($\theta$), as shown in FIG. 6. For simplicity of discussion, we can also assume the transfer efficiency=100%, that is, Pin=Po. Here Pin is the input power supplied by input voltage Vin and input current Iin. Po is the output power supplied to LEDs 403.

$$Po=[Ia\cdot\sin(\theta)]\cdot Vf;$$

$$Pin=[Ia\cdot\sin(\theta)\cdot D]\cdot[Va\cdot\sin(\theta)].$$

Here $Iin=Ia\cdot\sin(\theta\cdot D$ and D is the duty cycle of current Isw. Therefore, we can derive D as D=Vf/Vin=Vf/[Va·sin ($\theta$)].

$$Iin=Ia\cdot\sin(\theta)\cdot D=Ia\cdot\sin(\theta)\cdot Vf/[Va\cdot\sin(\theta)]=Ia\cdot Vf/Va.$$

Therefore, we know the input average current of Iin during the conduction angle from $\alpha$ to $\pi$-$\alpha$ is a constant value, Idc. Therefore Iin is a square wave. This can be observed in FIG. 6, too. Input current Iin is the average of current Isw. As Isw gets higher, its duty cycle decreases and its pulse width becomes shorter accordingly. The average is the constant Idc.

Now we can proceed to prove that the power factor of this embodiment is higher than the power factor of conventional LED driver circuits.

The power factor (PF) is defined as PF=(real power)/(apparent power)=Po/Pin.

The real power=$\int$Va·sin ($\theta$)*Idc d$\theta$=2Va·Idc·[−cos ($\theta$)], where $\theta$ is integrated from $\alpha$ to $\pi$-$\alpha$.=4Va·Idc·cos ($\alpha$)

The apparent power=Vin (rms)·Iin (rms)

Since Vin (rms)=Va/$\sqrt{2}$ and Iin (rms)=Idc·$[(\pi-2\alpha)/\pi]^{1/2}$, we can derive the apparent power=Va·Idc·$(2\pi)^{1/2}\cdot(\pi-2\alpha)^{1/2}$.

Therefore PF=4·cos ($\alpha$)/$[(2\pi)^{1/2}\cdot(\pi-2\alpha)^{1/2}]$.

FIG. 7 is a table showing the power factor of this embodiment under a variety of different values of $\alpha$. As shown in FIG. 7, for most values of $\alpha$ (smaller than 45°), the square input current actually has power factor much higher than that of conventional LED driver circuits. The best PF occurs at $\alpha$=25°, which is 0.96.

In summary, by using a simple buck converter topology, and by forcing the LED current to track the sinusoidal input voltage waveform, we achieve a square-wave like input current waveform. The input power factor can be as high as 0.96, much higher than that of conventional LED driver circuits. The size of the input capacitor is also greatly reduced. The circuit structure remains very simple and compact.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A buck converter LED driver circuit, comprising:

a buck power stage comprising an LED and providing a first signal directly proportional to the current through the LED;

a rectified AC voltage source coupled to the buck power stage for driving the buck power stage;

a voltage waveform sampler coupled to the rectified AC voltage source for providing a second signal directly proportional to the voltage provided by the rectified AC voltage source;

an SR flip-flop with an output end coupled to the buck power stage for turning on and turning off the buck power stage;

a clock generator coupled to the SR flip-flop for providing a clock signal to a setting end of the SR flip-flip; and a comparator with a positive end coupled to the buck power stage for receiving the first signal, a negative end coupled to the voltage waveform sampler for receiving the second signal, and an output end coupled to a resetting end of the SR flip-flop.

2. A buck converter LED driver circuit, comprising:

a buck power stage comprising an LED and providing a first signal directly proportional to the current through the LED;

a rectified AC voltage source coupled to the buck power stage for driving the buck power stage;

a voltage waveform sampler coupled to the rectified AC voltage source for providing a second signal directly proportional to the voltage provided by the rectified AC voltage source;

an SR flip-flop with an output end coupled to the buck power stage for turning on and turning off the buck power stage;

a comparator with a positive end coupled to the buck power stage for receiving the first signal, a negative end coupled to the voltage waveform sampler for receiving the second signal, and an output end coupled to a resetting end of the SR flip-flop; and a constant off-time generator coupled to the SR flip-flop and the comparator for triggering a setting end of the SR flip-flip at a predetermined constant time after the output of the comparator is asserted.

3. The driver circuit of claim 2, wherein the first and the second signals are voltage signals and the output of the comparator is asserted when the level of the first signal is higher than the level of the second signal.

4. The driver circuit of claim 3, wherein the voltage waveform sampler comprises:

a first resistor coupled to the rectified AC voltage source; and a second resistor coupled between the first resistor and a ground, wherein the second signal is provided at the joint of the first resistor and the second resistor.

5. The driver circuit of claim 2, wherein the buck power stage further comprises:

an inductor;

a diode;

a power switch; and a current sensor providing the first signal; wherein the LED, the inductor, the power switch, and the current sensor are coupled in series between the rectified AC voltage source and a ground; the power switch is coupled between the inductor and the current sensor; the LED, the inductor, and the diode are coupled as a current loop; the power switch is outside the current loop; the SR flip-flop turns on the buck power stage by turning on the power switch and turns off the buck power stage by turning off the power switch.

* * * * *